US007066816B2

(12) United States Patent
Gauselmann

(10) Patent No.: US 7,066,816 B2
(45) Date of Patent: Jun. 27, 2006

(54) BILL STACKER AND HOPPER ACCESS TECHNIQUE FOR A GAMING DEVICE

(75) Inventor: Michael Gauselmann, Espelkamp (DE)

(73) Assignee: Atronic International GmbH (DE)

( * ) Notice: Subject to any disclaimer, the term of this patent is extended or adjusted under 35 U.S.C. 154(b) by 8 days.

(21) Appl. No.: 10/339,517

(22) Filed: Jan. 8, 2003

(65) Prior Publication Data

US 2004/0132528 A1 Jul. 8, 2004

(51) Int. Cl.
*G07F 17/34* (2006.01)

(52) U.S. Cl. ..... 463/29; 463/30; 463/46; 463/47

(58) Field of Classification Search ..... 463/29–30, 463/20, 46–47; 273/143 R, 138.1
See application file for complete search history.

(56) References Cited

U.S. PATENT DOCUMENTS 5,224,707 A * 7/1993 Martin ..... 273/143 R
5,386,903 A 2/1995 Rothschild et al.
5,392,025 A 2/1995 Figh et al.
5,515,959 A * 5/1996 Stephenson et al. ..... 194/206
5,544,595 A * 8/1996 Stephenson et al. ..... 109/74
5,588,317 A 12/1996 Bianco
5,700,195 A * 12/1997 Halic ..... 463/29
5,729,212 A * 3/1998 Martin ..... 340/870.28
5,813,914 A 9/1998 McKay et al.
5,876,285 A * 3/1999 Salour et al. ..... 463/29
5,879,234 A * 3/1999 Mengual ..... 463/20
5,923,249 A * 7/1999 Muir ..... 340/545.1
5,931,104 A * 8/1999 Horn et al. ..... 109/59 R
5,971,515 A * 10/1999 Baker et al. ..... 312/329
6,066,038 A * 5/2000 Sciortino et al. ..... 453/17
6,113,097 A * 9/2000 Krutsch et al. ..... 273/118 A
6,146,274 A * 11/2000 Salour et al. ..... 463/29
6,364,769 B1 * 4/2002 Weiss et al. ..... 463/29
6,439,996 B1 * 8/2002 LeMay et al. ..... 463/29
6,488,585 B1 * 12/2002 Wells et al. ..... 463/43
6,575,833 B1 * 6/2003 Stockdale ..... 463/29
6,579,182 B1 * 6/2003 Orus et al. ..... 463/29
6,641,483 B1 * 11/2003 Luciano et al. ..... 463/46
2002/0183106 A1 12/2002 Cole
2004/0178217 A1 * 9/2004 Runnels ..... 221/268

OTHER PUBLICATIONS

European Search Report, 3 pages.

* cited by examiner

*Primary Examiner*—Eugene Kim
*Assistant Examiner*—Dolores R. Collins
(74) *Attorney, Agent, or Firm*—Patent Law Group LLP; Brian D. Ogonowsky

(57) ABSTRACT

In a gaming machine, unlocking a first lock enables an attendant to open the front door of the gaming machine, allowing access to the internal circuitry of the gaming machine but not allowing access to the money in the gaming machine. Unlocking a second lock enables an attendant to open a second access barrier to gain access to the money. Since access to the internal circuitry is separated from access to the money, better security control is provided.

27 Claims, 6 Drawing Sheets

BILL STACKER AND HOPPER ACCESS TECHNIQUE FOR A GAMING DEVICE

FIELD OF THE INVENTION

This invention relates to gaming machines and, in particular, to a method and structure for gaining access to cash within the gaming machine.

BACKGROUND

Gaming machines in casinos typically require a player to insert coins or bills into the machine in order to generate credits for playing a game. The game may be a spinning reels type game, a card game, a video game, or any other type of game.

Casinos employ elaborate security methods to restrict access to the inside of the gaming machine. Allowing access to the electrical and software portion of the gaming machine may enable someone to manipulate the game's operation to create an unauthorized winning outcome of the game. Allowing access to the coin hopper and bill stacker enables the money to be stolen.

Accordingly, it is desirable to reduce the likelihood of tampering with the gaming machine and stealing money from the gaming machine.

SUMMARY

In one embodiment of the inventive gaming machine, unlocking a first lock enables an attendant to open the front door of the gaming machine, allowing access to the internal circuitry of the gaming machine but not allowing access to the money in the gaming machine. Unlocking a second lock enables an attendant to gain access to the money. A person authorized to have access to the money may not be authorized to have assess to the internal circuitry, and vice versa. Since access to the internal circuitry is separated from access to the money, better security control is provided.

In one embodiment, the second lock allows a front coin tray to be moved to access a bill stacker and coin hopper. When the second lock is actuated, the attendant can laterally slide the coin tray (e.g., to the left) to gain access to the bill stacker containing the bills. The attendant removes the full bill stacker and replaces the stacker with an empty stacker. In one embodiment, a separate key is required to remove the bill stacker from the gaming machine. The bill stacker box itself is typically locked and requires a different key to gain access to the bills inside.

To gain access to the coin hopper, the coin tray is pulled forward, like a drawer, along with the coin hopper. Coins may be added to or removed from the hopper. To gain full access to the hopper for maintenance, the coin tray is tilted down. As an added advantage, since the front door does not need to be opened for gaining access to the stacker or hopper, players at adjacent machines are not disturbed.

For machines that do not pay out coins and only accept bills, a movable front panel may be used instead of a coin tray to gain access to the bill stacker.

DETAILED DESCRIPTION

Although the invention can be implemented by modifying most types of modern gaming machines, one particular gaming machine platform will be described in detail.

Figure 1:
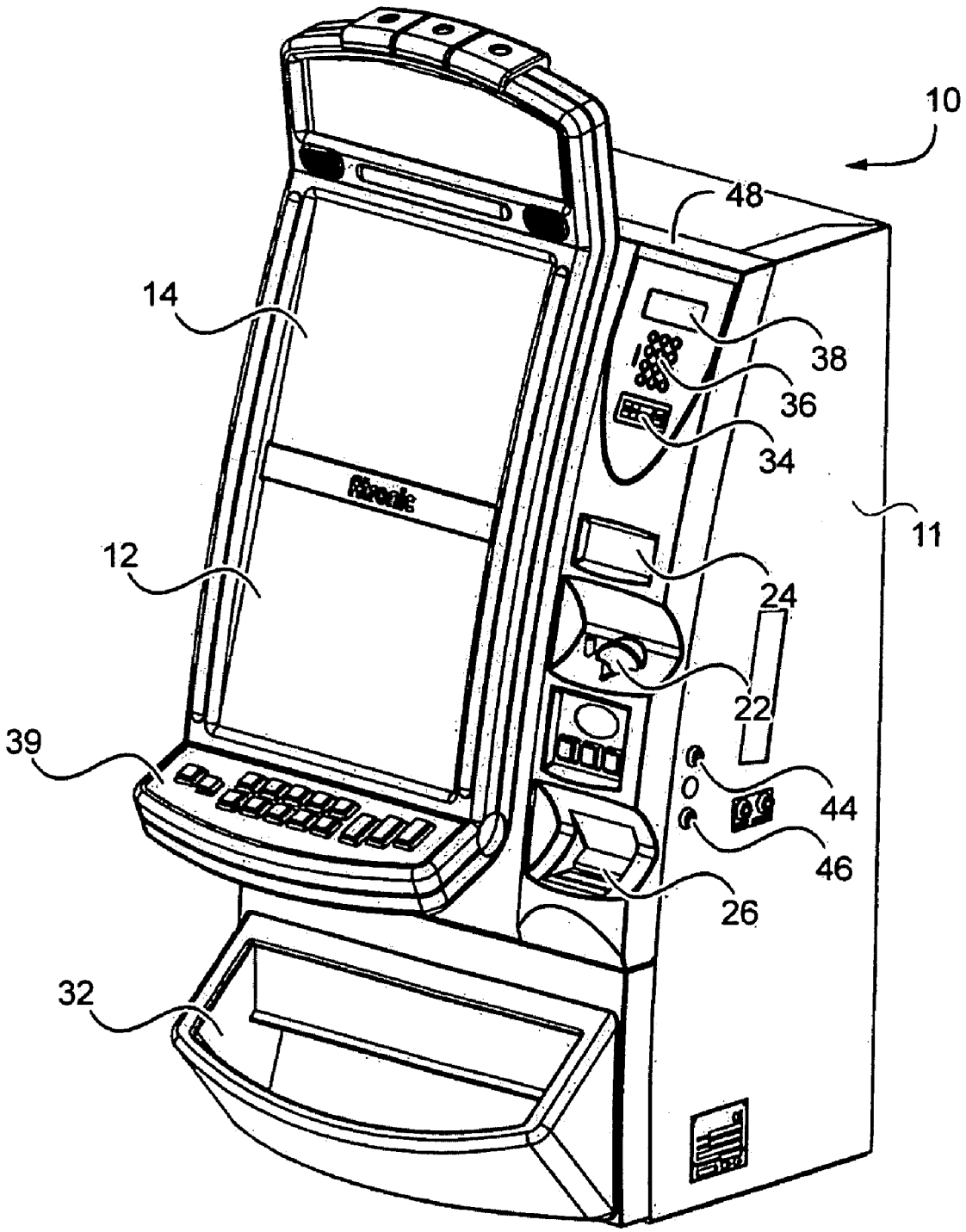
FIG. 1 is a perspective view of a gaming machine in accordance with one embodiment of the invention.

FIG. 1 is a perspective view of a gaming machine 10 in accordance with one embodiment of the present invention. Machine 10 includes a cabinet 11 housing a display 12 that may be a thin film transistor (TFT) display, a liquid crystal display (LCD), a cathode ray tube (CRT), or any other type of display. A second display 14 provides game data or other information in addition to display 12. Display 14 may provide static information, such as an advertisement for the game, the rules of the game, pay tables, paylines, or other information, or may even display the game itself along with display 12. Alternatively, the area for display 14 may be a display glass for conveying information about the game.

A coin slot 22 accepts coins or tokens in one or more denominations to generate credits within machine 10 for playing games. An input slot 24 for an optical reader and printer receives machine readable printed tickets and outputs printed tickets for use in cashless gaming. A bill acceptor 26 accepts various denominations of banknotes.

A coin tray 32 receives coins or tokens from a hopper upon a win or upon the player cashing out.

A card reader slot 34 accepts any of various types of cards, such as smart cards, magnetic strip cards, or other types of cards conveying machine readable information. The card reader reads the inserted card for player and credit information for cashless gaming. The card reader may also include an optical reader and printer for reading and printing coded barcodes and other information on a paper ticket.

A keypad 36 accepts player input, such as a personal identification number (PIN) or any other player information. A display 38 above keypad 36 displays a menu for instructions and other information and provides visual feedback of the keys pressed.

Player control buttons 39 include any buttons needed for the play of the particular game or games offered by machine 10 including, for example, a bet button, a repeat bet button, a play two-ways button, a spin reels button, a deal button, hold cards buttons, a draw button, a maximum bet button, a cash-out button, a display paylines button, a display payout tables button, select icon buttons, and any other suitable button.

The game played may be a spinning reel type game, either using physical reels or simulated reels on a video screen, or the game may be a card game, such as poker. Any other game may be played.

Figure 2:
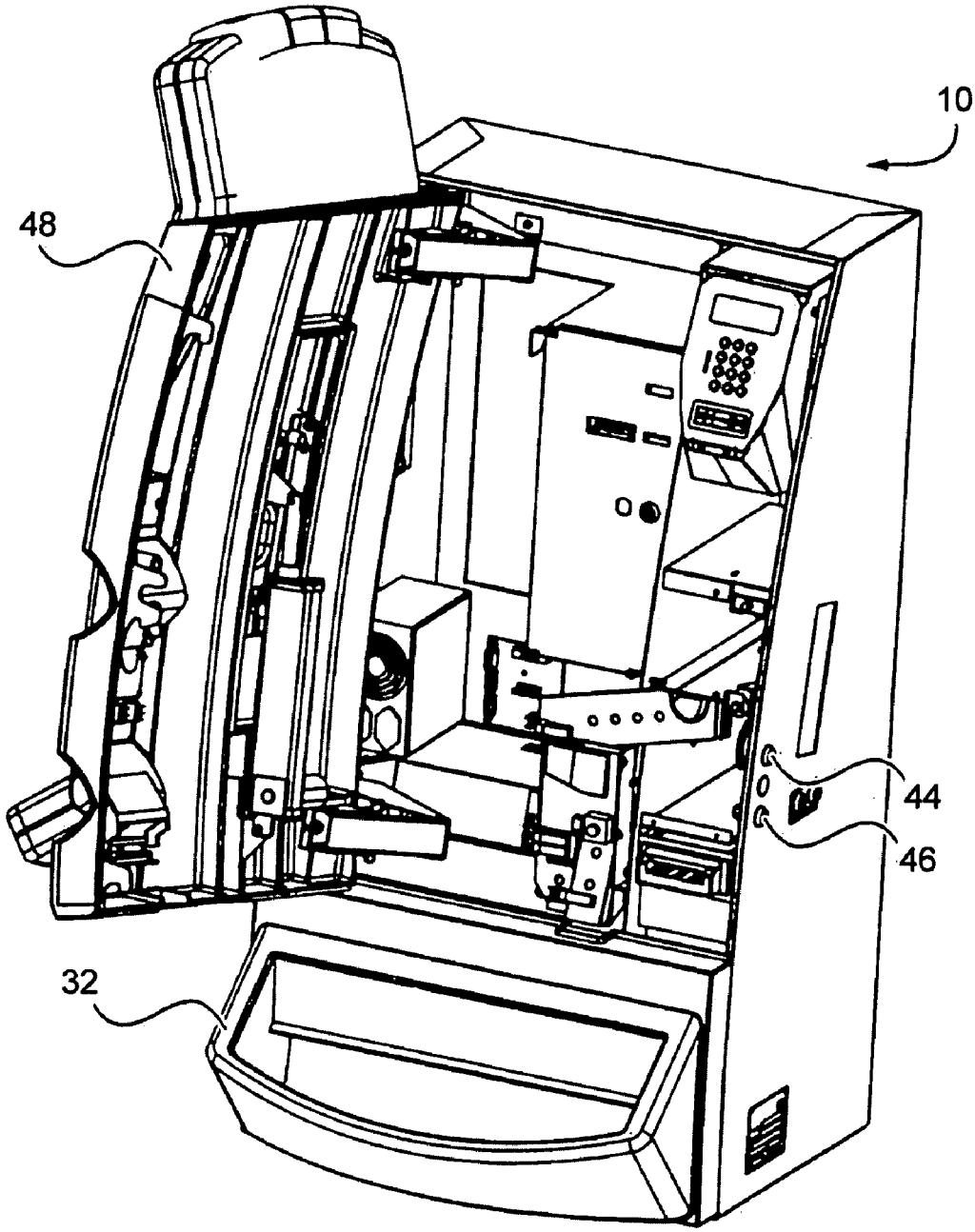
FIG. 2 illustrates the gaming machine of FIG. 1 with its front door open.

A first lock 44, when unlocked with a key, allows the attendant to open the main door 48, as shown in FIG. 2. This allows access to the circuitry and software (e.g., the game program) in the machine for service. Lock 44 may be any type of suitable lock. Door 48 need not be on a hinge but may be attached to cabinet 11 in any manner.

Another service performed on the machine is removing money from the gaming machine, because either the bill stacker is full or the hopper is full, or adding coins to the hopper to allow coin payouts to the player. It is typically not desirable to allow the unskilled attendant that handles the money to gain access to the internal circuitry of the gaming machine, whose access should be restricted to skilled service technicians. Additionally, if the front of the machine were opened to reveal both the money portion of the machine and the circuitry, the risk of electrical shock would be greatly increased when handling the money. Further, for security reasons, access to the circuitry and money should be limited. Also, opening the front door of a gaming machine for accessing the stacker and hopper disturbs players playing adjacent gaming machines. Accordingly, it is advantageous to separate access to the electrical circuitry and the money.

Figure 3:
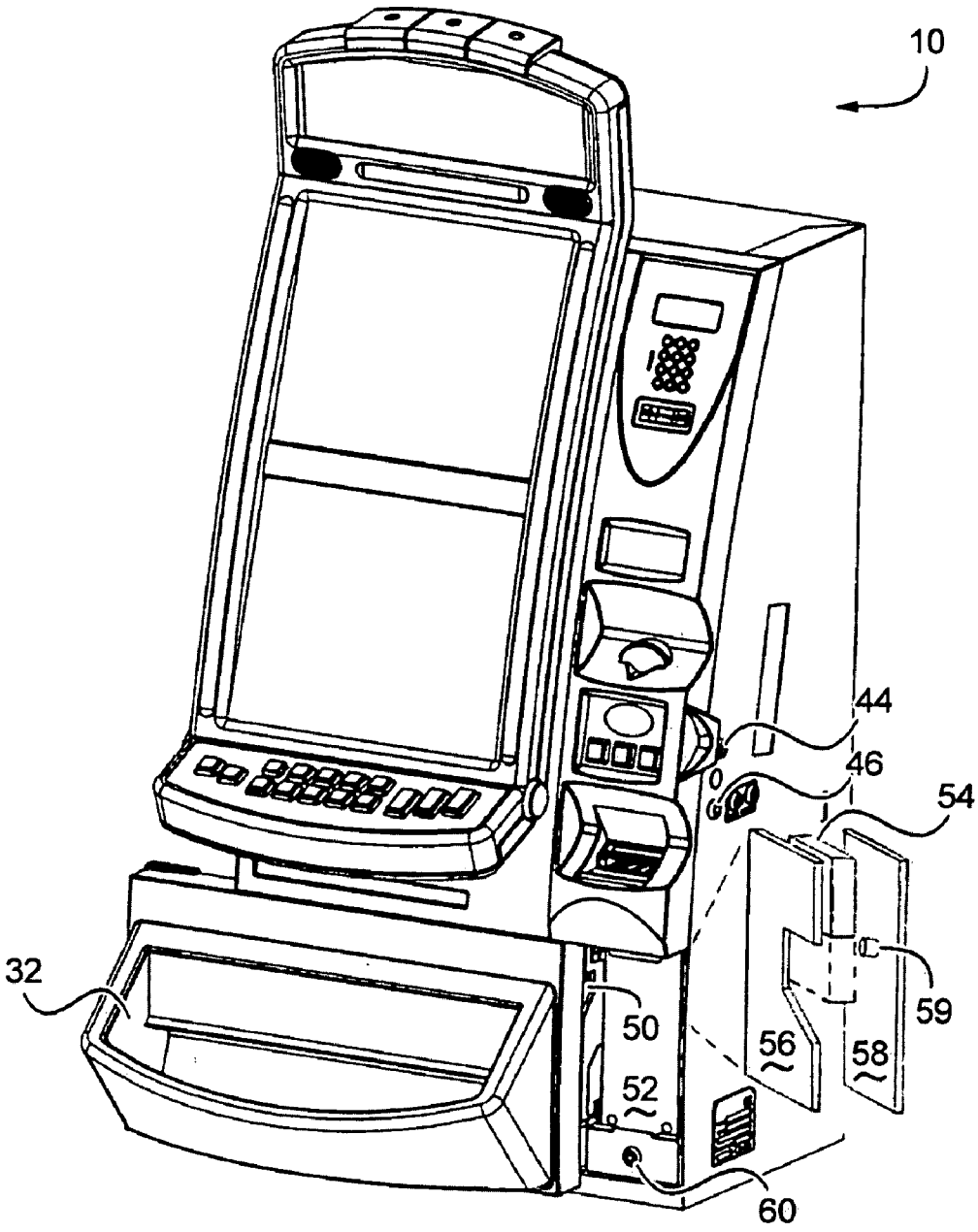
FIG. 3 illustrates the gaming machine of FIG. 1 with its coin tray slid to the left so as to allow access to the bill stacker.

Referring to FIG. 3, a second lock 46, when unlocked with a second key, unlocks coin tray 32 from its normal position. In one embodiment, lock 46 cannot be unlocked with a key unless door 48 is closed and in a locked position. Accordingly, locks 44 and 46 are coupled to levers that prevent the turning of one lock when the other lock is in an unlocked state. Such a coupling may take on any suitable form.

Actuating lock 46 by turning a key removes a blocking bar 54 from a coin tray latch 50 (better shown in FIG. 6), which allows coin tray 32 to be manually slid to the left to gain access to the bill stacker 52, shown in FIG. 3. FIG. 3 shows an expanded portion of the blocking bar 54 that is mechanically raised and lowered by turning a key inserted into lock 46. When in a locked position, coin tray latch 50 fits within metal walls 56 and 58. Blocking bar 54, when in a down position (shown in dashed lines), prevents coin tray 32 from being shifted to the left. A pin 59 also engages latch 50 to prevent coin tray 32 from being pulled out while in a locked position. Other means, to be described later, block coin tray 32 from being tilted forward. Other latches may also be utilized to further secure coin tray 32 in place.

After shifting coin tray 32 to the left a sufficient amount, the attendant can quickly access bill stacker 52. Bill stacker 52 may be locked into position using a third lock 60 (FIG. 3), requiring a different key. Turning of the key in lock 60 releases a latch that secures stacker 52 in place, and stacker 52 is then pulled out by the attendant and replaced with an empty stacker.

Figure 4:
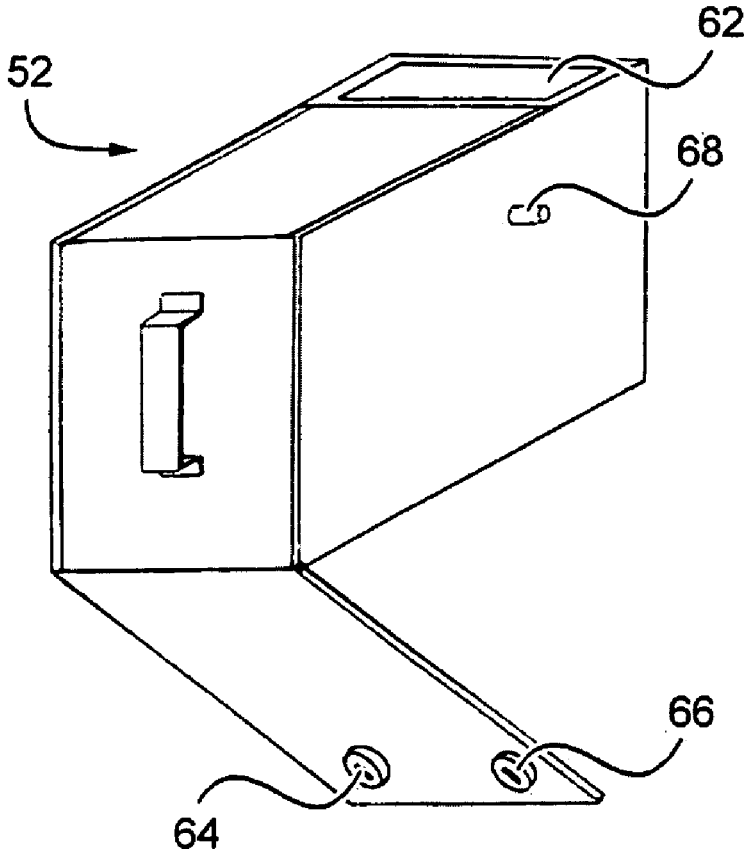
FIG. 4 illustrates the bill stacker removed and opened up to gain access to the bills.

FIG. 4 shows stacker 52 in greater detail. The handle of bill stacker 52 is not shown in the other drawings for simplicity. Stacker 52 includes an input slot 62 into which bills are drawn after being inserted into bill acceptor 26 (FIG. 1). A motor and pulley system may be incorporated into stacker 52, or externally to stacker 52, to forward bills through opening 62 so as to stack the bills inside stacker 52. A pin 68 helps guide stacker 52 along a track internal to machine 10. Bill stackers are well known, and any conventional bill stacker may be used.

Since the casino may not want the attendant to have access to the bills within stacker 52, locks 64 and 66 are provided on stacker 52. Locks 64 and 66 require different keys so the casino can require two people to unlock stacker 52 to further increase security.

Accordingly, stacker 52 may be removed and replaced with an empty stacker within seconds due to the minimum movement required of coin tray 32 in gaining access to stacker 52. The attendant need not gain access to the internal circuitry of machine 10 in order to access stacker 52.

Figure 5:
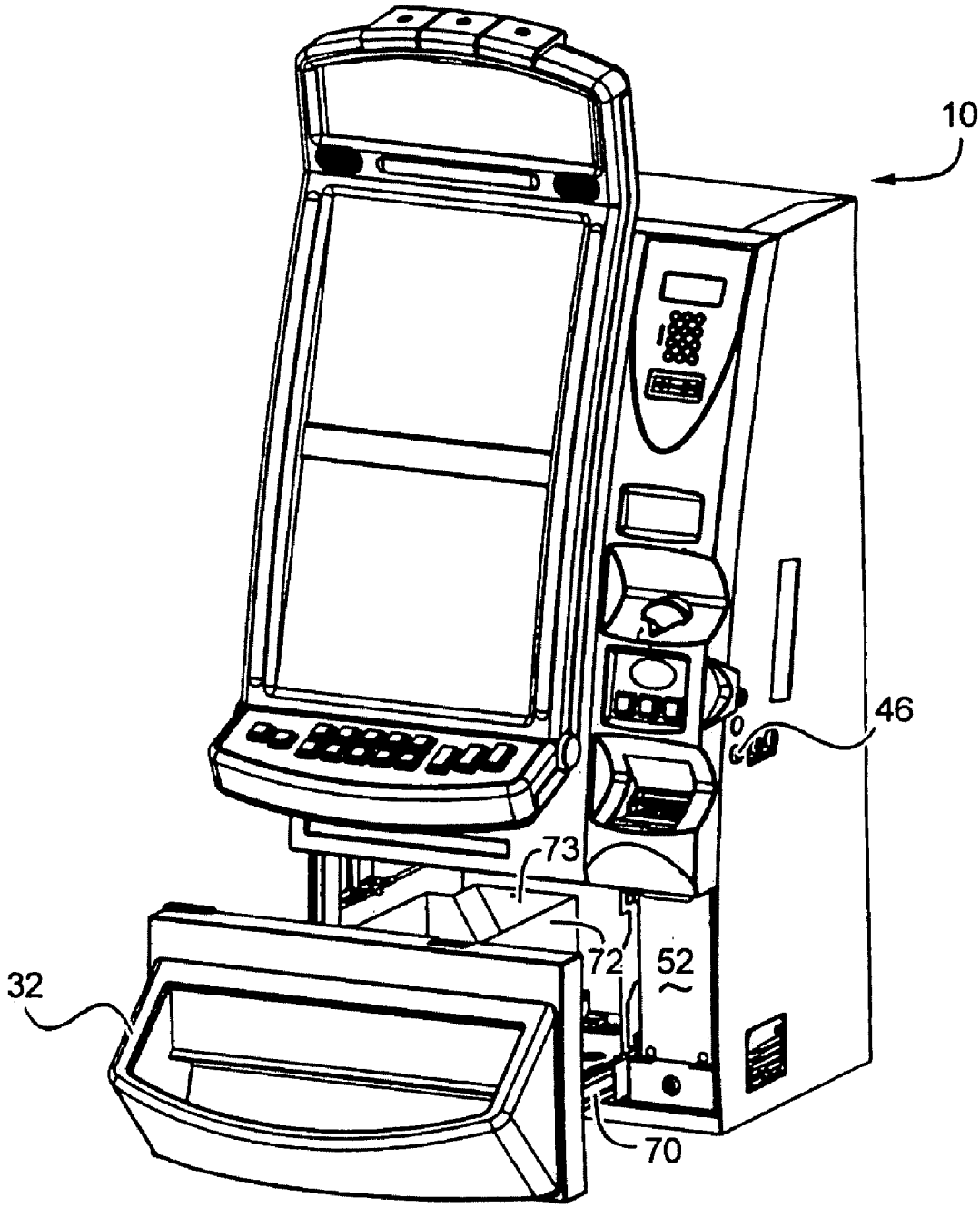
FIG. 5 illustrates the coin tray pulled out away from the front of the gaming machine to gain access to the coin opening in the hopper.

To access the coin hopper to either remove coins from the hopper or add coins to the hopper, coin tray 32 is pulled forward, as shown in FIG. 5, after being released by lock 46. Coin tray 32 is attached to a drawer 70 supporting coin hopper 72. In one embodiment, the sliding out of drawer 70 may be performed whether or not coin tray 32 has been slid to expose stacker 52. Sliding out drawer 70 gains access to the top opening 73 of hopper 72 to add or remove coins.

Figure 6:
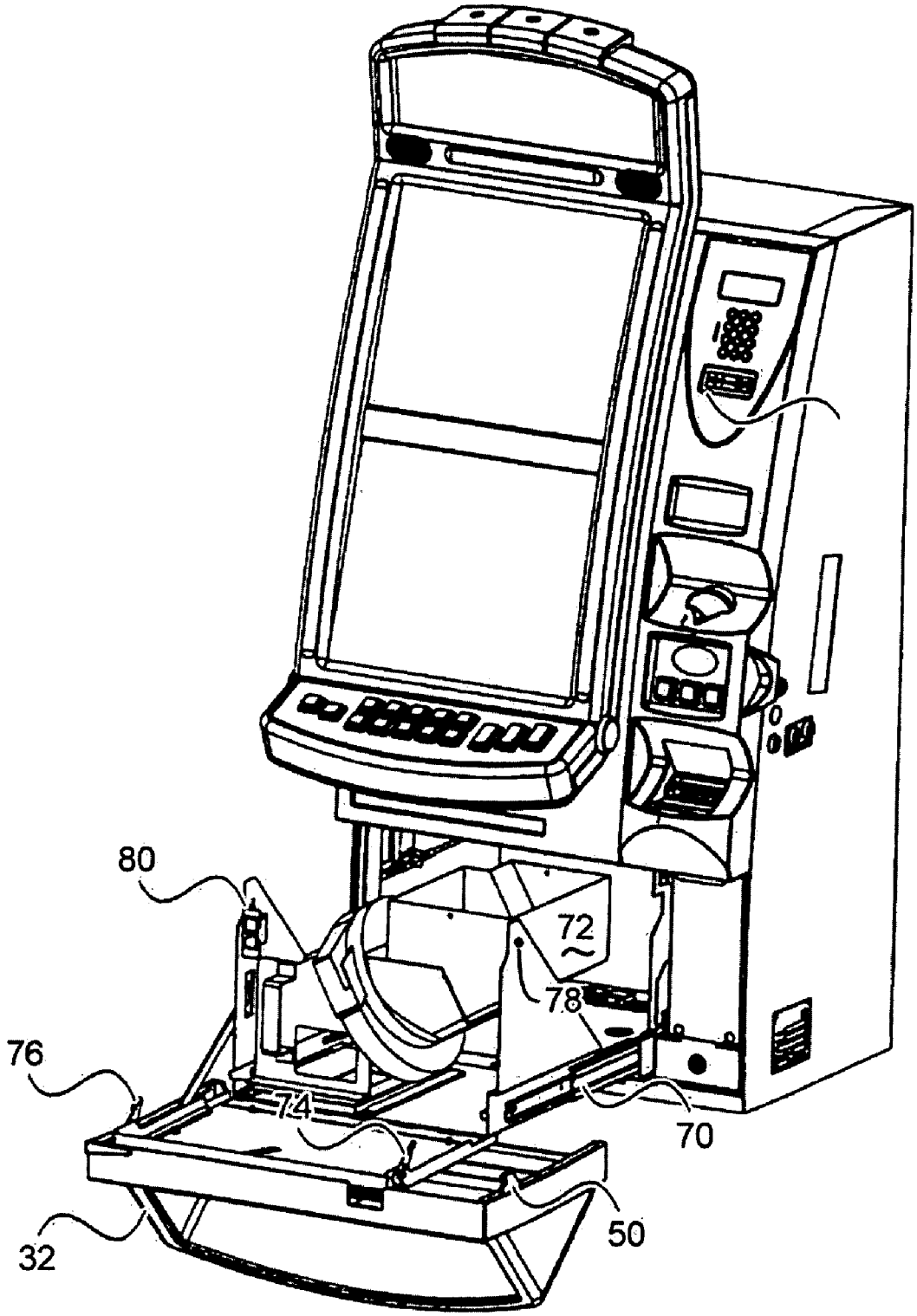
FIG. 6 illustrates the coin tray tilted down to gain full access to the hopper.

If the hopper needs servicing, full access to the hopper mechanism is typically required. FIG. 6 demonstrates how coin tray 32 may be tilted down to reveal the entire hopper 72. To unlatch coin tray 32 from its upright position, the attendant manually lifts up a spring-loaded latch 74, which releases latch 74 and the corresponding latch 76 on the opposite side from pins 78 and 80.

In one embodiment of the invention, coin tray 32 is not laterally movable to gain access to the bill stacker, and access to both the stacker and the hopper is obtained by pulling out coin tray 32. However, as discussed above, certain advantages are obtained by allowing coin tray 32 to be laterally slid to reveal the bill stacker. In other embodiments, coin tray 32 does not have the capability of being tilted downward.

In an additional embodiment, the invention is applied to a gaming machine where coins are not inserted or paid out by the machine, so there is no coin tray. However, the machine may still accept bills. The payouts in such machines are typically in the form of a coded paper ticket, a smart card transfer, a magnetic stripe card transfer, or other type of non-cash payment. In such a case, coin tray 32 is replaced by a panel, such as a display panel. The panel is coupled to the gaming machine in a manner similar to the coupling of coin tray 32, wherein a separate lock enables the panel to be moved to gain access to the bill stacker without allowing the attendant to gain access to the circuitry internal to the gaming machine.

The invention allows different people to have access to the circuitry portion of the gaming machine and the money portion of the gaming machine, greatly alleviating security problems for the casino. The invention also reduces the possibility of electrical shock by separating the money portion of the machine from the circuitry portion. Further, since the front door does not need to be opened for gaining access to the stacker or hopper, players at adjacent machines are not disturbed. The invention described herein may be applied to any type of gaming machine, including those operating with a central server.

The movable coin tray 32 or panel may be located anywhere on the machine and the machine may take any form, such as a slant top machine, a mechanical spinning reels type device, a video game device, or any other machine.

Having described the invention in detail, those skilled in the art would appreciate that given the present disclosure, modifications may be made to the invention without departing from the spirit of the inventive concepts described herein. Therefore, it is not intended that the scope of the invention be limited to the specific embodiments illustrated and described.

What is claimed is:

1. A gaming device comprising:

a cabinet housing first components, including a game display and circuitry for operating the gaming device, the first components not including any money storage receptacle, the cabinet also housing at least one money storage receptacle;

a first access barrier, the first access barrier having a first access state and a first barrier state, the first access state providing access to only the first components but not access to any money storage receptacle, the first barrier state blocking access to the first components;

a second access barrier, the second access barrier having a second access state and a second barrier state, the second access state providing access to the at least one money storage receptacle but not access to the first components, the second barrier state blocking access to the at least one money storage receptacle;

a first lock for locking the first access barrier in the first barrier state and for unlocking the first access barrier to enable the first access barrier to be moved to the first access state; and a second lock for locking the second access barrier in the second barrier state and for unlocking the second access barrier to enable the second access barrier to be moved to the second access state, wherein the second access barrier is a coin tray, wherein the at least one money storage receptacle comprises a bill stacker and a coin hopper, the second access state comprising:

a first state providing access to only the bill stacker, and a second state providing access to the coin hopper.

2. The device of claim 1 wherein the first access barrier comprises a door.

3. The device of claim 1 wherein the second state provides access to both the bill stacker and the coin hopper.

4. The device of claim 1 wherein the at least one money storage receptacle comprises a bill stacker and a coin hopper.

5. The device of claim 1 wherein the at least one money storage receptacle comprises a bill stacker.

6. The device of claim 1 wherein the at least one money storage receptacle comprises a bill stacker, the bill stacker having a third lock and a fourth lock for preventing unauthorized access to bills in the bill stacker.

7. The device of claim 1 wherein the at least one money storage receptacle comprises a bill stacker, the device further comprising a third lock that, when in a locked state, prevents removal of the bill stacker from the gaming device and, in an unlocked state, allows removal of the bill stacker from the gaming device.

8. The device of claim 1 wherein the first lock and the second lock are key locks.

9. The device of claim 1 wherein the first lock and second lock are located on a side of the cabinet.

10. The device of claim 1 further comprising a bill acceptor for receiving a bill inserted into the gaming device by a player and for forwarding the bill to a bill stacker.

11. The device of claim 1 further comprising a coin acceptor for receiving coins inserted into the gaming device by a player and for forwarding coins for deposit in a coin hopper.

12. The device of claim 1 wherein the at least one money storage receptacle comprises a coin hopper, the coin hopper being coupled to the second access barrier such that moving the second access barrier away from a front of the gaming device also moves the coin hopper from a position internal to the cabinet to a position at least partially out of the cabinet to allow access to an opening in the coin hopper.

13. The device of claim 1 further comprising a manually operated latch for tilting down the second access barrier, after the second access barrier has been unlocked, to provide access to the at least one money storage receptacle.

14. The device of claim 1 further comprising a display screen for displaying a game.

15. The device of claim 1 wherein the gaming device is a slot machine displaying spinning reels.

16. The device of claim 1 wherein the first access barrier is prevented from being in the first access state when the second access barrier is in the second access state, and wherein the second access barrier is prevented from being in the second access state when the first access barrier is in the first access state.

17. A gaming device comprising:

a cabinet housing first components for operating the gaming device, the first components not including any money storage receptacle, the cabinet also housing at least one money storage receptacle;

a first access barrier, the first access barrier having a first access state and a first barrier state, the first access state providing access to only the first components but not access to any money storage receptacle, the first barrier state blocking access to the first components;

a second access barrier, the second access barrier having a second access state and a second barrier state, the second access state providing access to the at least one money storage receptacle but not access to the first components, the second barrier state blocking access to the at least one money storage receptacle;

a first lock for locking the first access barrier in the first barrier state and for unlocking the first access barrier to enable the first access barrier to be moved to the first access state; and a second lock for locking the second access barrier in the second barrier state and for unlocking the second access barrier to enable the second access barrier to be moved to the second access state, wherein the second access barrier is slideable substantially linearly and laterally with respect to a front of the gaming device.

18. The device of claim 17 wherein the second access barrier is slideable laterally to provide access to a bill stacker.

19. The device of claim 17 wherein the at least one money storage receptacle comprises a bill stacker and a coin hopper, the second access state comprising:

a first state providing access to only the bill stacker, and a second state providing access to the coin hopper.

20. A gaming device comprising:

a cabinet housing first components for operating the gaming device, the first components not including any money storage receptacle, the cabinet also housing at least one money storage receptacle;

a first access barrier, the first access barrier having a first access state and a first barrier state, the first access state providing access to only the first components but not access to any money storage receptacle, the first barrier state blocking access to the first components;

a second access barrier, the second access barrier having a second access state and a second barrier state, the second access state providing access to the at least one money storage receptacle but not access to the first components, the second barrier state blocking access to the at least one money storage receptacle;

a first lock for locking the first access barrier in the first barrier state and for unlocking the first access barrier to enable the first access barrier to be moved to the first access state; and a second lock for locking the second access barrier in the second barrier state and for unlocking the second access barrier to enable the second access barrier to be moved to the second access state, wherein the second access barrier is mounted so as to be pulled in a direction substantially linearly in a forward direction with respect to a front of the gaming device to provide access to the at least one money storage receptacle.

21. The device of claim 20 wherein the second access barrier is mounted on a drawer, and wherein the at least one money storage receptacle is mounted on the drawer.

22. The device of claim 20 wherein the at least one money storage receptacle comprises a bill stacker and a coin hopper, the second access state comprising:

a first state providing access to only the bill stacker, and a second state providing access to the coin hopper.

23. A method performed on a gaming machine, the gaming machine having a cabinet housing first components for operating the gaming device, the first components not including any money storage receptacle, the cabinet also housing at least one money storage receptacle, the method comprising:

moving a first access barrier between a first access state and a first barrier state, the first access state providing access to only the first components but not access to any money storage receptacle, the first barrier state blocking access to the first components; and moving a second access barrier between a second access state and a second barrier state, the second access state providing access to the at least one money storage receptacle but not access to the first components, the second barrier state blocking access to the at least one money storage receptacle, wherein moving the second access barrier comprises sliding the second access barrier substantially linearly and laterally to provide access to a bill stacker.

24. The method of claim 23 further comprising:

actuating a first lock for unlocking the first access barrier to enable the first access barrier to be moved to the first access state; and actuating a second lock for unlocking the second access barrier to enable the second access barrier to be moved to the second access state.

25. A method performed on a gaming machine, the gaming machine having a cabinet housing first components for operating the gaming device, the first components not including any money storage receptacle, the cabinet also housing at least one money storage receptacle, the method comprising:

moving a first access barrier between a first access state and a first barrier state, the first access state providing access to only the first components but not access to any money storage receptacle, the first barrier state blocking access to the first components; and moving a second access barrier between a second access state and a second barrier state, the second access state providing access to the at least one money storage receptacle but not access to the first components, the second barrier state blocking access to the at least one money storage receptacle, wherein moving the second access barrier comprises pulling the second access barrier in a direction substantially linearly in a forward direction with respect to a front of the gaming device to provide access to the at least one money storage receptacle.

26. The method of claim 25 wherein the second access barrier is mounted on a drawer, and wherein the at least one money storage receptacle is mounted on the drawer.

27. The method of claim 26 wherein the at least one money storage receptacle comprises a coin hopper and a bill stacker.

* * * * *